US007159579B2

(12) United States Patent
Meiller et al.

(10) Patent No.: US 7,159,579 B2
(45) Date of Patent: Jan. 9, 2007

(54) RESILIENT SLING FOR MOUNTING A CARBON MONOLITH IN AN EVAPORATIVE EMISSIONS CANISTER

(75) Inventors: Thomas C. Meiller, Pittsford, NY (US); Brian A. Tinch, North Chili, NY (US)

(73) Assignee: Delphi Technologies, Inc., Troy, MI (US)

( * ) Notice: Subject to any disclaimer, the term of this patent is extended or adjusted under 35 U.S.C. 154(b) by 129 days.

(21) Appl. No.: 11/079,870

(22) Filed: Mar. 14, 2005

(65) Prior Publication Data

US 2006/0065252 A1 Mar. 30, 2006

Related U.S. Application Data

(63) Continuation-in-part of application No. 10/955,264, filed on Sep. 30, 2004, now Pat. No. 7,051,717.

(51) Int. Cl.
*F02M 33/02* (2006.01)

(52) U.S. Cl. ..... 123/518; 123/519

(58) Field of Classification Search ..... 123/516, 123/518, 519, 520

See application file for complete search history.

(56) References Cited

U.S. PATENT DOCUMENTS 3,831,353 A * 8/1974 Toth ..... 96/144
5,207,808 A * 5/1993 Haruta et al. ..... 96/131
6,564,821 B1 * 5/2003 Orenstein et al. ..... 137/202

* cited by examiner

*Primary Examiner*—Thomas Moulis
(74) *Attorney, Agent, or Firm*—Paul L. Marshall

(57) ABSTRACT

An emissions control canister including an insert tube and a final scrubber inside the tube. Because a scrubber formed as a carbon monolith is relatively fragile and easily damaged, a flexible, porous, resilient sling is provided for installing and retaining scrubber within cylindrical tube in lieu of either seals or elastomeric gaskets. An end of the scrubber is placed on a center portion of the sling, and the straps are folded alongside the cylindrical surface of the scrubber to form a sub-assembly. The sling is die-cut from planar stock of either a loose, thick, woven polyester fabric or an open-cell resilient foam. Advantages of the sling over a resilient elastomeric gasket are cost, ease of assembly, and the outer surface of the scrubber is made available as additional vapor adsorption area.

7 Claims, 8 Drawing Sheets

RESILIENT SLING FOR MOUNTING A CARBON MONOLITH IN AN EVAPORATIVE EMISSIONS CANISTER

RELATIONSHIP TO OTHER APPLICATIONS AND PATENTS

The present application is a Continuation-In-Part of U.S. patent application Ser. No. 10/955,264, filed Sep. 30, 2004, now U.S. Pat. No. 7,051,717.

TECHNICAL FIELD

The present invention relates to a device for controlling evaporative emissions from vehicles; more particularly, to a device for controlling hydrocarbon emissions during refueling and shutdown; and most particularly, to a resilient sling for mounting a formed carbon scrubber into a tubular member in an emission-adsorption canister.

BACKGROUND OF THE INVENTION

Canisters for controlling evaporative emissions from vehicles are well known. Such emissions are created at two particular times: first, while a vehicle is being refueled, and vapor-laden air is being displaced from the fuel tank (known in the art as "refueling emissions"); and second, while a vehicle is shut down for an extended period, and fuel-laden adsorber in a canister spontaneously degases to the atmosphere (known in the art as "diurnal emissions" or "bleed" emissions).

In the prior art, refueling emissions are collected typically by a canister disposed between a port in the vehicle fuel tank and outside atmosphere. The canister has two side-by-side chambers filled with an adsorptive carbon composition and connected at one end such that gases follow a U-shaped flow path through the canister. Valving is provided such that the canister can be degassed of fuel by engine vacuum when the vehicle's engine is restarted. In desorption mode, outside air is drawn into the canister in reverse flow through the adsorption mode exhaust port and sweeps adsorbed fuel from the carbon beds into the engine intake manifold.

The California Air Resources Board (CARB) has published more stringent emissions regulations, known generally as Low Emission Vehicle II (LEV II) and Partial Zero Emission Vehicle (PZEV). PZEV is more stringent than LEV II.

The CARB first adopted LEV standards in 1990. These first LEV standards ran from 1994 through 2003. LEV II regulations, running from 2004 through 2010, represent continuing progress in emission reductions. As the state's passenger vehicle fleet continues to grow and more sport utility vehicles and pickup trucks are used as passenger cars rather than work vehicles, the new, more stringent LEV II standards are necessary for California to meet federally-mandated clean air goals outlined in the 1994 State Implementation Plan (SIP). When LEV II is fully implemented in 2010, it is estimated that smog-forming emissions in the Los Angeles area will be reduced by 57 tons per day, while the statewide reduction will be 155 tons per day.

PZEV-conforming vehicles are those that have achieved the CARB's cleanest tailpipe emission standard—the Super Ultra Low Emission Vehicle (SULEV) standard. In addition, they have nearly zero evaporative emissions and their emission control equipment is warranted for 15 years/150,000 miles.

Prior art canisters as described above have been capable of meeting the original LEV standards, and with the addition of a downstream carbon "scrubber" can meet the PZEV standards. For both LEV II and PZEV applications, the canister's diurnal emission performance can be greatly improved by increased flow path length and partitioning of the carbon bed. These features allow the carbon closest to the fresh air source to be very well purged, and keep migrating hydrocarbon vapors away from the atmospheric port.

One means known in the art for partitioning a canister is to provide a horizontal plate in the carbon bed, breaking the bed into two shorter chambers. An opening in the plate allows flow between chambers. The opening must be large enough to allow for acceptable flow restriction performance. Because the driving pressure for flow through a canister is very low, it is an important design consideration that flow restriction be kept to a minimum. This configuration requires two separate filings and settlings of loose carbon into the canister and thus increases manufacturing cost.

A downstream carbon scrubber to meet PZEV diurnal emission levels is known to be installed either in line at the atmospheric port of a canister or in an added dedicated chamber molded onto the canister housing itself. Either configuration increases the overall size of a canister, which is undesirable because of space considerations in the region of a vehicle wherein a canister is installed. Thus what is needed in the art is means for incorporating a scrubber within the existing volume of a prior art canister while still meeting PZEV emission standards.

Another means for improving the efficiency of a canister is to increase the L/D ratio wherein L is the length of the flow path and D is its average diameter. Therefore, what is further needed in the art is an improved canister having an increased L/D ratio.

Formed monolithic carbon scrubbers are fragile and easily broken during canister assembly and use. Therefore, what is further needed in the art is a resilient means for installing and retaining a carbon scrubber in a canister.

It is a principal object of the present invention to provide a simple, inexpensive, resilient means for installing and retaining a carbon scrubber into an emissions-adsorption canister.

SUMMARY OF THE INVENTION

Briefly described, an emissions control canister in accordance with the invention includes improvements within the second of two parallel carbon bed chambers arranged for sequential flow of emissions from a fuel tank to atmosphere. An insert shaped roughly like an inverted top hat having an elongate bowl and a brim (flange) is disposed at the outlet end of the second chamber, the elongated bowl portion extending into the chamber. When the chamber is charged with carbon, the carbon column thus takes the form of a hollow cylinder around the insert rather than a solid cylinder as in the prior art.

In a first embodiment in accordance with the invention, after the vapors flow through the hollow cylinder column of carbon adsorbent, the flow is directed through holes in the flange and out through the atmosphere port. The path for fuel vapors to flow along the hollow cylinder has a much increased L/D ratio as compared to the ratio for a solid cylinder of comparable length. This arrangement also reduces the total volume of carbon required for the canister.

In a second embodiment, the chamber is provided with a thin cylindrical tube surrounding the atmosphere port and extending into the insert. Flow through the flange cannot escape directly to the atmosphere port as in the first embodiment but rather is forced along a tortuous path between the cylindrical tube and the insert wall, makes a 180° turn at the end of the tube, and then again flows the length of the tube before reaching the atmosphere port. The tortuous path reduces flow of hydrocarbons from the carbon beds to atmosphere, especially diurnal emissions which are driven only by diffusion and therefore are path-length sensitive.

In a third embodiment, for meeting PZEV standards a cylindrically-shaped scrubber is added inside the cylindrical tube so that the flow, after making the second 180°, is directed through the scrubber which is formed, preferably, as a pressed carbon monolith having a plurality of longitudinal passageways. The scrubber preferably is secured and centered in the tube via a porous, compressible strap, also referred to herein as a resilient sling, that extends around the end and along the sides of the scrubber to hold the scrubber resiliently within the tube.

The disclosed canister design allows a single canister to be used for both LEV II needs (second embodiment) and PZEV needs (third embodiment) simply by installing a scrubber in the insert to meet PZEV requirements. Where neither PZEV nor LEV II standards is required, the cylindrical wall may be omitted, and the insert still provides emissions control superior to that provided by the prior art solid-cylinder carbon fill.

BRIEF DESCRIPTION OF THE DRAWINGS

The present invention will now be described, by way of example, with reference to the accompanying drawings, in which.

DESCRIPTION OF THE PREFERRED EMBODIMENTS

The benefits of an improved emissions adsorption canister in accordance with the invention may be better appreciated by first considering exemplary prior art canisters.

Figure 1:
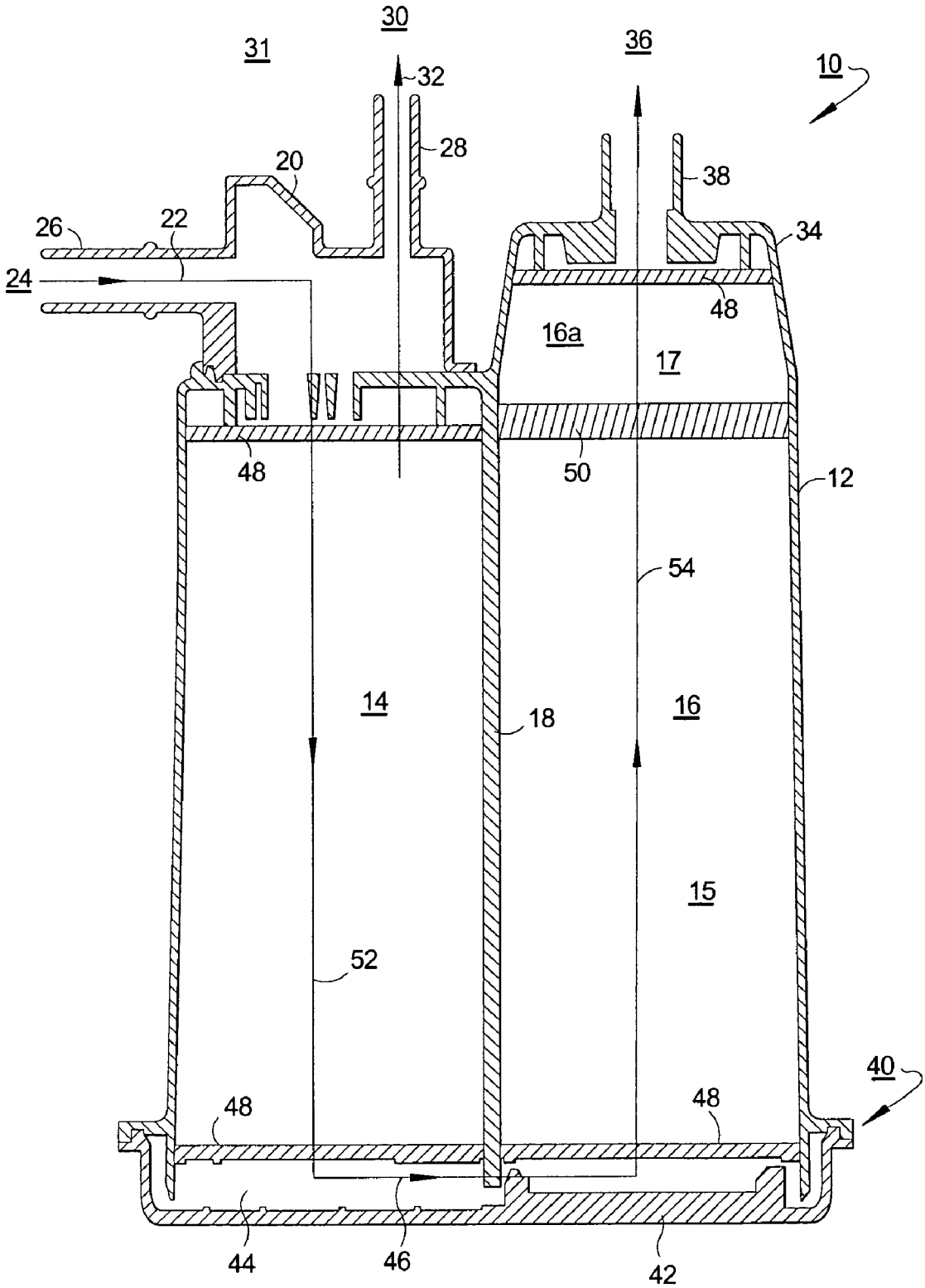
FIG. 1 is an elevational cross-sectional view of a prior art two-chamber emissions adsorption canister, configured for meeting LEV II requirements.

Referring to FIG. 1, a first prior art emissions adsorption canister 10 comprises a housing 12 including a first chamber 14 separated from a second chamber 16 by a septum 18.

Housing 12 includes a first molded end cap 20 formed on first chamber 14 for receiving and distributing vapors 22 entering from a fuel tank 24 via an entrance port 26. Cap 20 includes a second port 28 selectively connectable to an internal combustion engine 30 for vacuum purge of adsorbed emissions 32 in reverse flow through canister 10. Typically, fuel tank 24 and engine 30 are components of a vehicle 31. The adsorption and purge modes are separated and regulated by valving and logical control means (not shown).

Housing 12 includes a second end cap 34 formed on second chamber 16 for connecting second chamber 16 to atmosphere 36 via atmosphere port 38.

Housing 12 is molded such that first and second chambers 14,16 may be filled with emissions adsorbent, typically activated carbon 15, from open end 40 by inverting housing 12. Open end 40 is closed by a third end cap 42 having a crossover space 44 formed therein for allowing vapor flow 46 between chambers 14,16 in either direction. Perforated plates 48 keep the carbon from migrating within and out of the canister while permitting flow therethrough at low pressure resistance. An additional plate 50 is disposed across second chamber 16 and defines a final chamber 16*a* which may be filled with special adsorption material 17 having better bleed emissions performance.

In adsorption mode of prior art canister 10, vapors 22 flow through cap 20 and are partially adsorbed in chamber 14. Additional vapors 52 flow through chamber 14, crossover space 44 (vapors 46), and are additionally adsorbed 54 in chambers 16,16*a*. Air initially in canister 10 is expelled via atmosphere port 38.

In desorption mode, flow through the canister is reversed. First, a connection is opened between port 28 and engine 30. Then, vapors 32 are stripped from carbon in chambers 14,16,16*a* by atmospheric air drawn in through port 38 and are conveyed to engine 30 where they are combusted.

As noted above, a shortcoming of prior art canister 10 is the relatively low L/D ratio in chamber 16*a* making it less efficient. Further, chamber 16*a* must be filled with carbon and settled and plate 50 installed in separate steps prior to the main filling step for chambers 14,16, at additional manufacturing complexity and cost.

Figure 2:
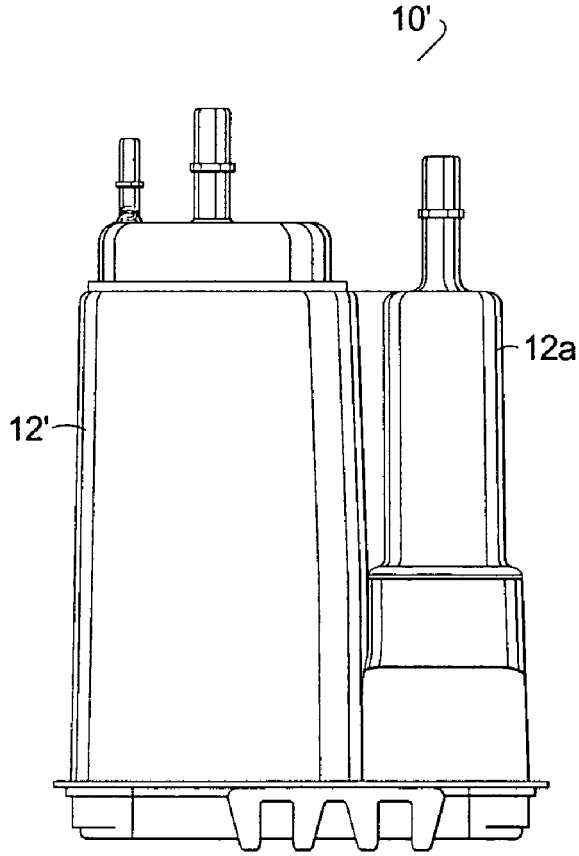
FIG. 2. PRIOR ART
FIG. 2 is an elevational view of a first prior art canister, showing a molded receptacle in the housing for incorporating a scrubber to meet PZEV requirements.

Referring to FIG. 2, a second embodiment 10' of a prior art canister includes a housing 12' having an integrally molded receptacle 12*a* for receiving a hydrocarbon scrubber (not visible) to meet PZEV standards.

Figure 3:
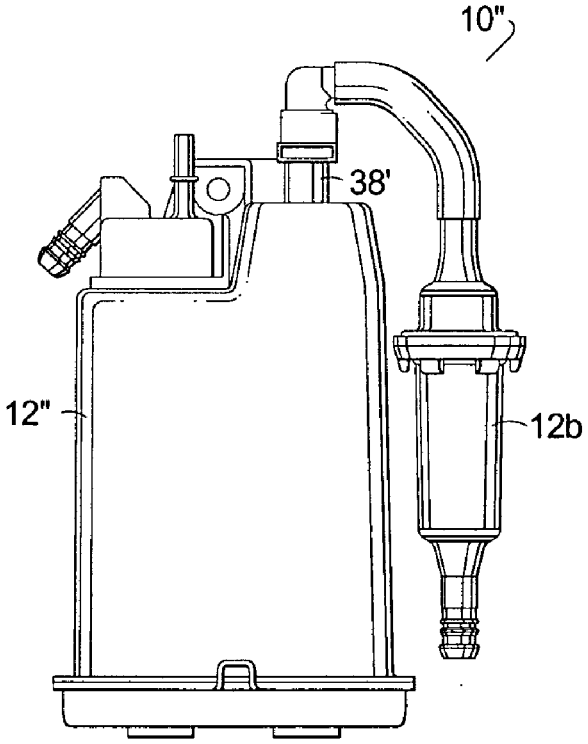
FIG. 3. PRIOR ART
FIG. 3 is an elevational view of a second prior art canister, showing a separate scrubber housing attached downstream of the atmosphere port in the canister to meet PZEV requirements.

Referring to FIG. 3, a third embodiment 10" of a prior art canister includes a housing 12" and a separate scrubber housing 12*b* connected to the atmosphere port 38' of housing 12".

Figure 4:
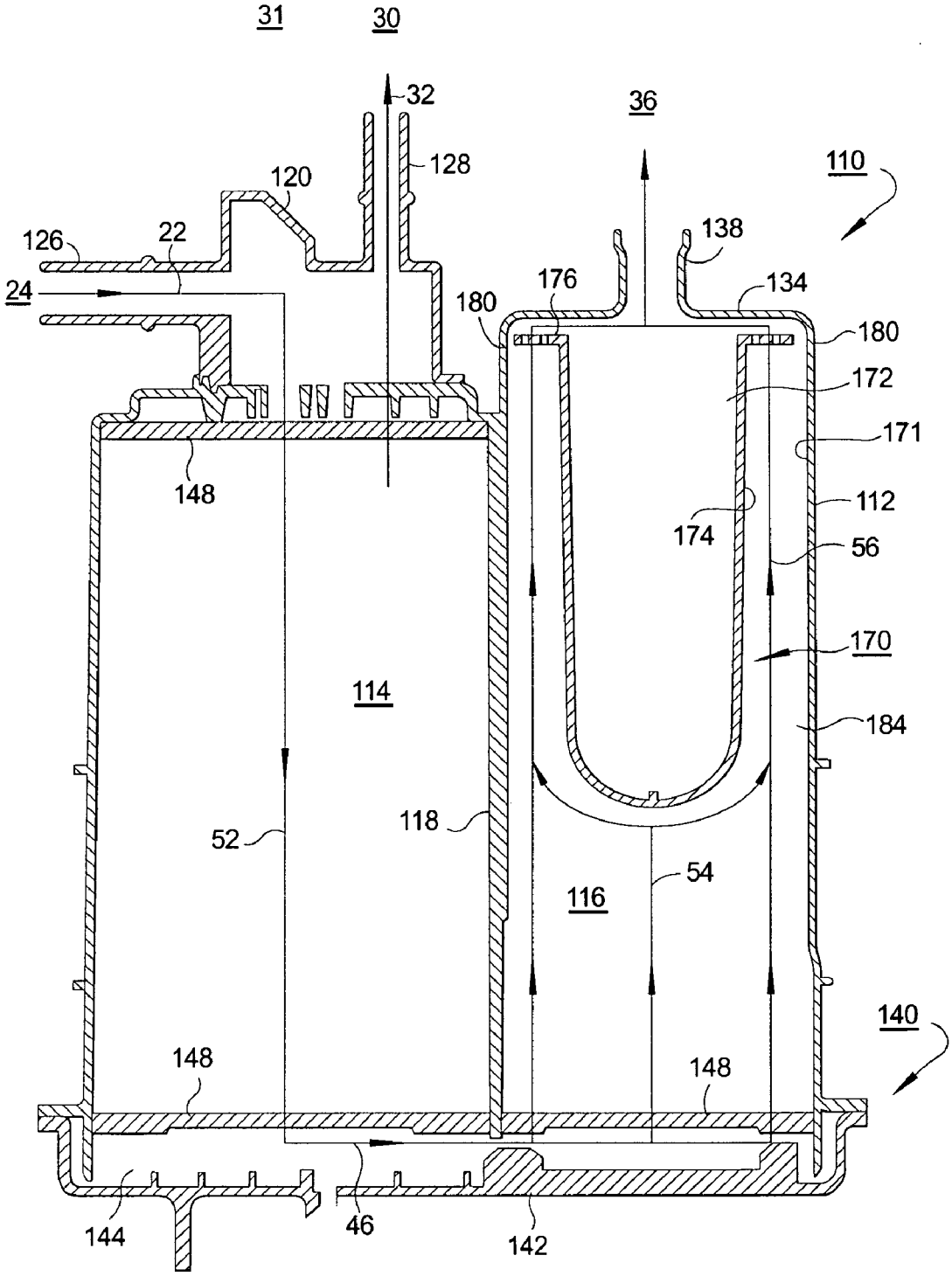
FIG. 4 is an elevational cross-sectional view of a first embodiment of an improved two-chamber emissions adsorption canister in accordance with the invention.
Figure 5:
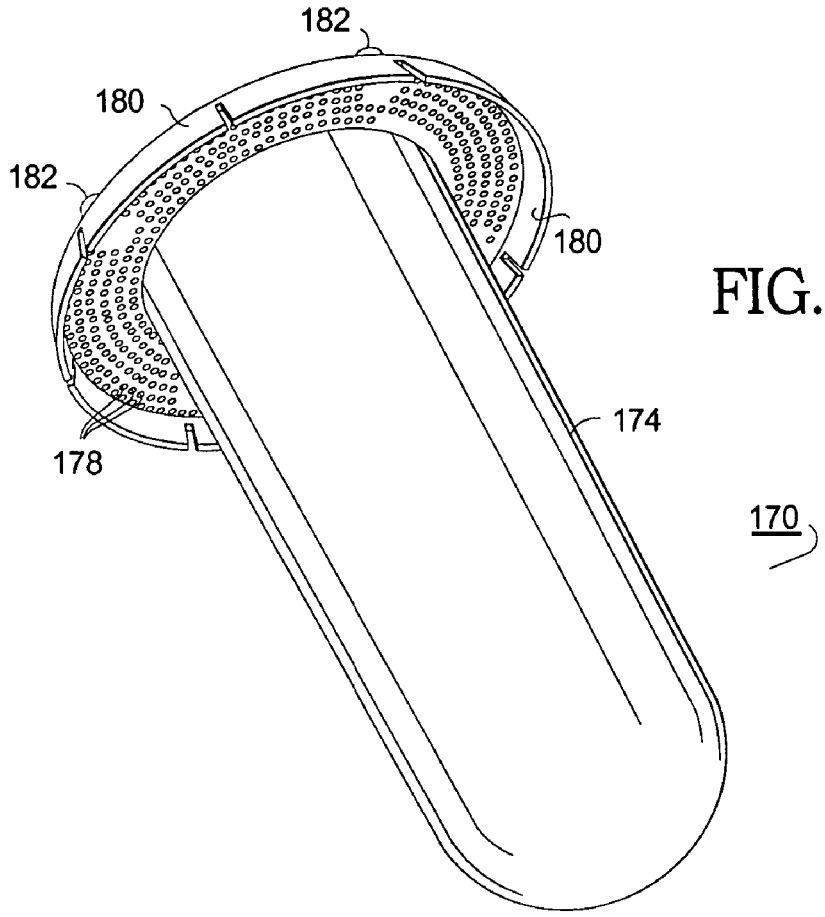
FIG. 5 is an isometric view from beneath of an insert for use in an improved canister in accordance with the invention.
Figure 6:
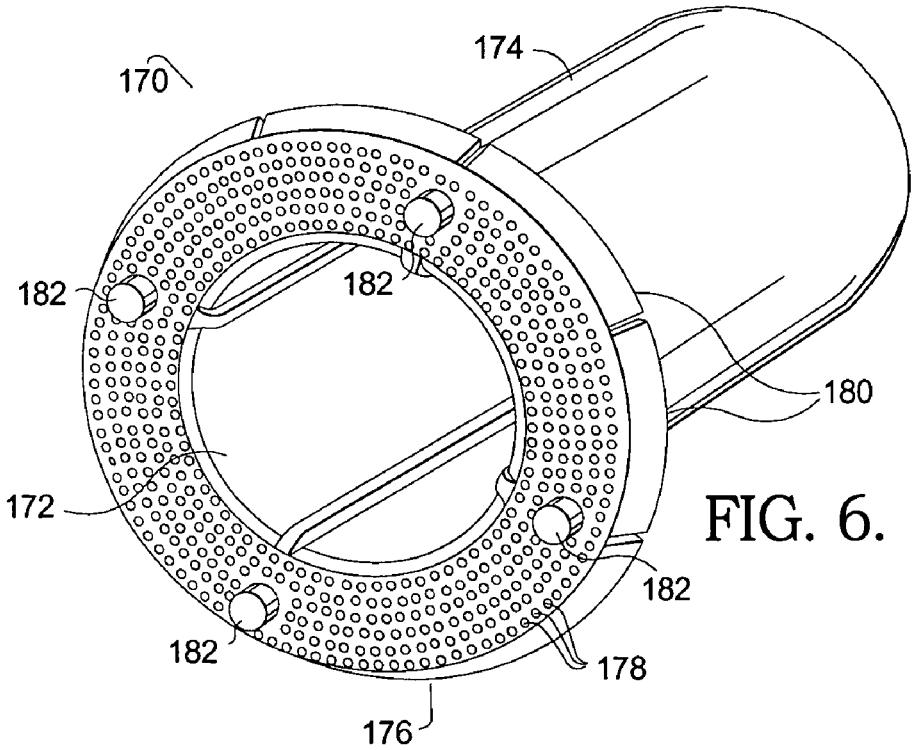
FIG. 6 is an isometric view from above of the insert shown in FIG. 5.

Turning now to improved canisters in accordance with the invention, referring to FIGS. 4 through 6, a first embodiment 110 of an improved canister comprises a housing 112 including a first chamber 114 separated from a second chamber 116 by a septum 118.

Housing 112 includes a first molded end cap 120 on first chamber 114 for receiving and distributing vapors 22 entering from a fuel tank 24 via an entrance port 126. Cap 120 includes a second port 128 connectable to an internal combustion engine 30 for vacuum purge of adsorbed emissions 32 in reverse flow through canister 110. The adsorption and purge modes are separated and regulated by conventional valving and logical control means (not shown).

Housing 112 includes an integral second end cap 134 on second chamber 116 for connecting second chamber 116 to atmosphere 36 via atmosphere port 138.

Housing 112 is molded such that first and second chambers 114,116 may be filled with emissions adsorbent, typically activated carbon, from open end 140 by inverting housing 112. Open end 140 is closed after such filling by a third end cap 142 having a crossover space 144 formed therein for allowing vapor flow 46 between chambers 114, 116 in either direction. Perforated plates 148 keep the carbon from migrating within and out of the canister while permitting flow therethrough at low pressure resistance.

Prior art additional plate 50 is replaced by a generally "hat-shaped" insert 170 having a central well 172 formed by a cylindrical wall 174 and a flanged rim 176 surrounding the opening to well 172. Flanged rim 176 is provided with a plurality of perforations 178 for low-resistance passage of vapors therethrough, and is further provided with a plurality of flexible peripheral wipers 180 and spacer posts 182 extending axially of insert 170. During assembly of canister 110, insert 170 is inserted, open end forward, into second chamber 116 through end 140 and is advanced until stopped by posts 182 engaging cap 134. Wipers 180 are resiliently compressed against the walls of chamber 116, centering the insert and retaining the insert against cap 134 while carbon adsorbent is filled around insert 170, creating a hollow cylinder 184 of adsorbent between insert 170 and wall 171 of chamber 116. Of course, carbon is further added to fill both chambers 114,116.

In adsorption mode of improved canister 110, vapors 22 flow through end cap 120 and are partially adsorbed in chamber 114. Additional vapors 52 flow through chamber 114, crossover space 144 (vapors 46), and are additionally adsorbed 54 in chamber 116. Vapor flow 56 in the hollow cylinder-shaped carbon region 184 around insert 170 is especially efficient in removing emissions because of an increased L/D ratio. Air initially in canister 110 is expelled via atmosphere port 138.

In desorption mode, flow is reversed through the canister. First, a connection is opened between port 128 and engine 30. Then, vapors 32 are stripped from carbon in chambers 114,116 by atmospheric air drawn in through port 138 and are conveyed to engine 30 where they are combusted.

As noted above, a benefit of improved canister 110 is the increased L/D ratio in second chamber 116, making the unit significantly more efficient. Because chamber 116 is filled with carbon and settled along with chamber 114, manufacturing complexity and cost are reduced over the prior art.

Figure 7:
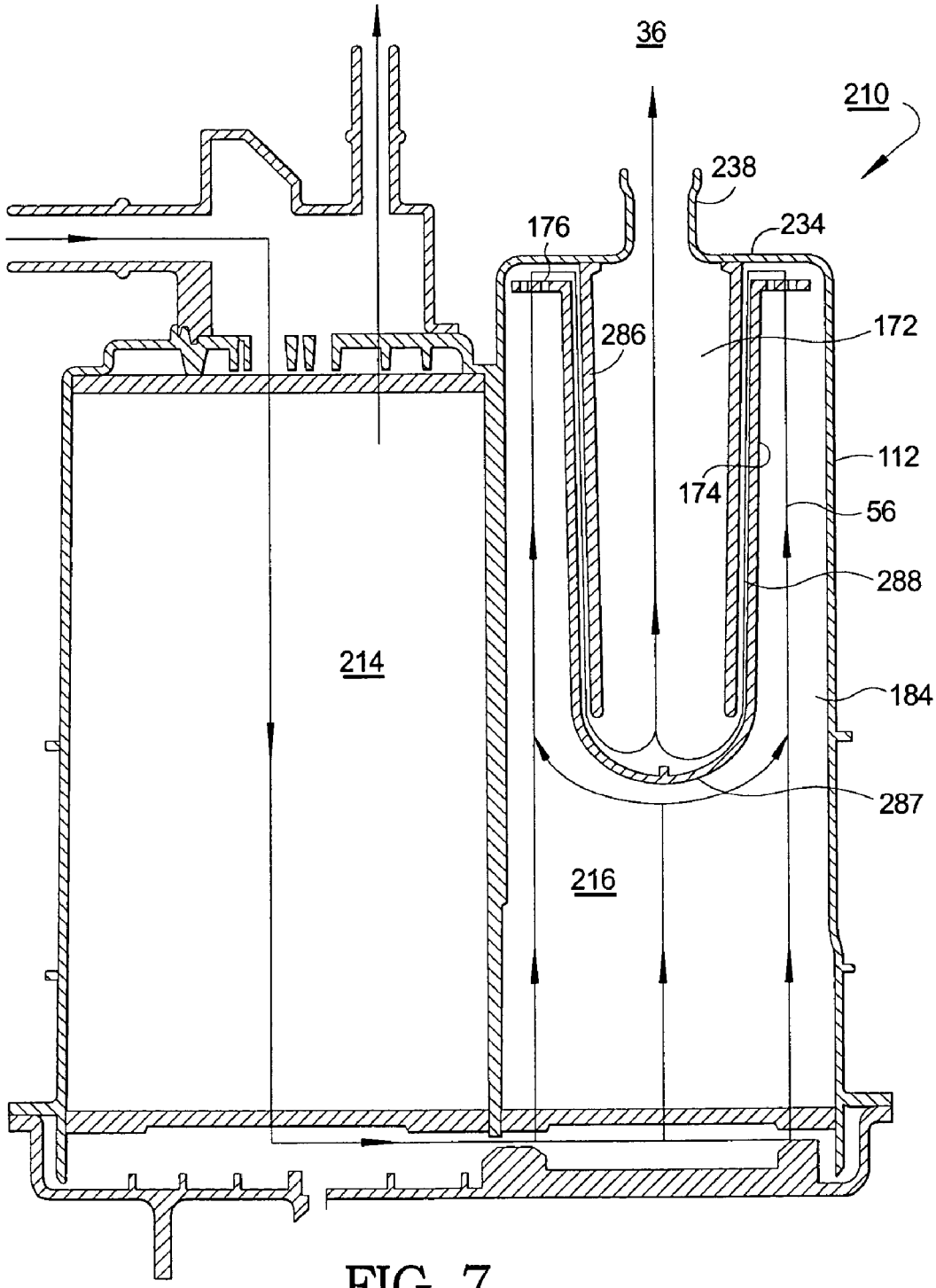
FIG. 7 is an elevational cross-sectional view of a second embodiment of an improved two-chamber emissions adsorption canister in accordance with the invention.
Figure 8:
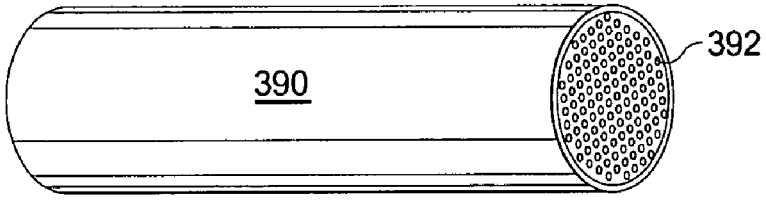
FIG. 8 is an isometric side view of a scrubber monolith for use in the tube shown in FIGS. 7, 11, and 12.

Referring to FIG. 7, a second embodiment 210 of an improved emissions adsorption canister is substantially identical with first embodiment 110, and numbering of most of the identical elements is omitted for clarity. The novel feature of embodiment 210 is the addition of a cylindrical tubular member ("tube") 286 formed integrally with second chamber cap 234, surrounding atmosphere port 238, and extending axially into second chamber 216, forming thereby a tortuous pathway for flow of vapor. The diameter of tube 286 is selected such that the tube extends into insert 170 and is slightly offspaced therefrom, creating an annular flow space 288 between tube 286 and insert wall 174. The result is that vapor flow 56 passing through hollow cylinder-shaped region 184 and perforated rim 176 cannot exit second chamber 216 immediately. Instead, the vapor is directed through a first 180° turn into annular space 288, travels the length of tube 286 into the bowl end 287 of central well 172, makes a second 180° turn, and again travels the length of tube 286 before exiting at port 238. The extended diffusion pathway afforded by tube 286 in insert 170 greatly reduces diurnal bleed of vapors adsorbed onto carbon in the canister. Second embodiment 210 is intended to meet LEV II standards when the volume and carbon loading of chambers 214,216 is sized properly for a specific emissions load, the determination of which is well known in the art of engine emissions adsorption.

Figure 11:
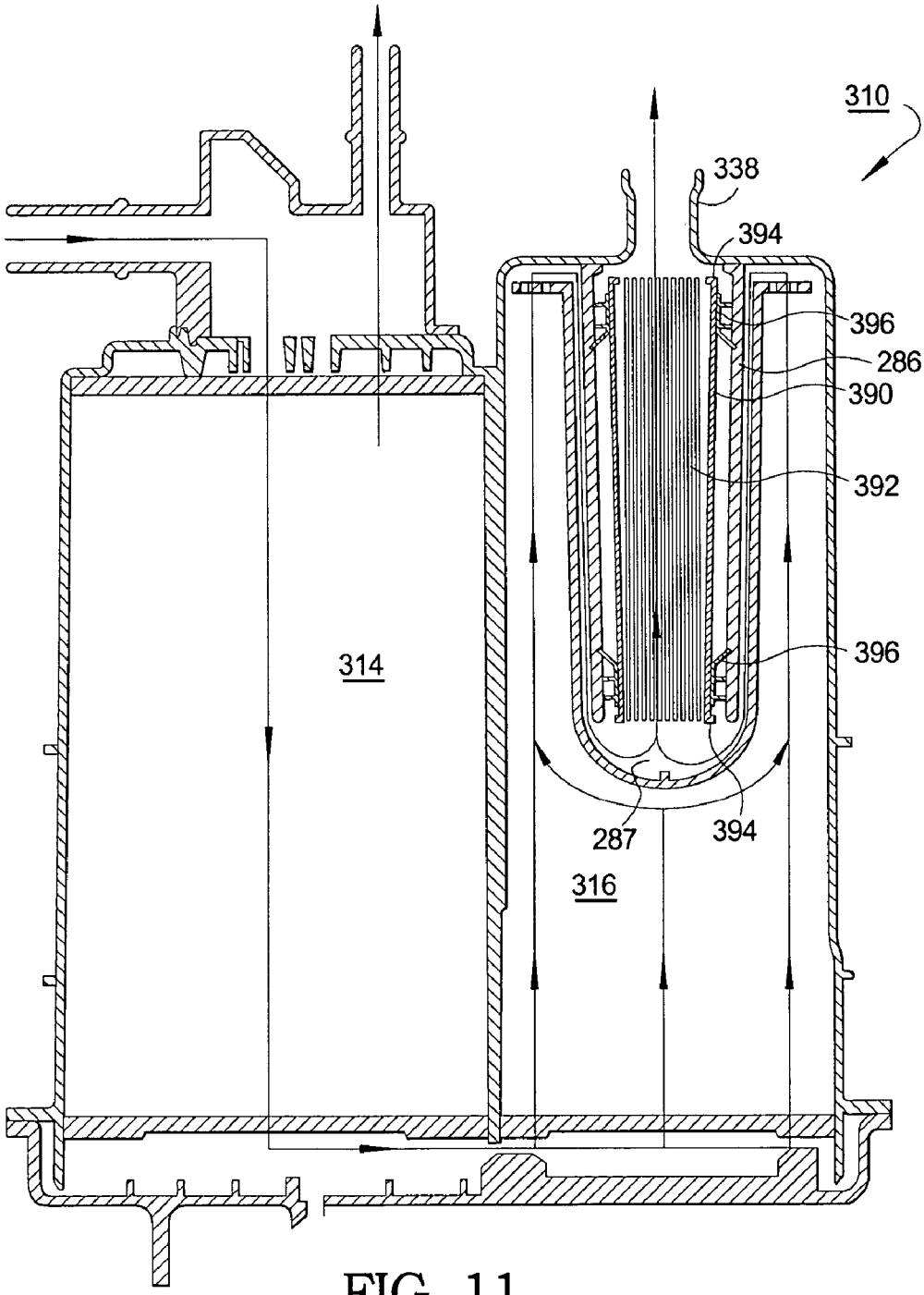
FIG. 11 is an elevational cross-sectional view of a third embodiment of an improved two-chamber emissions adsorption canister in accordance with the invention, showing the scrubber installed to meet PZEV requirements.

Referring to FIG. 11, a third embodiment 310 of an improved emissions adsorption canister is identical with second embodiment 210 in all respects save one, and numbering of most elements is omitted for clarity. The novel feature of embodiment 310 is the addition of a high-efficiency vapor scrubber 390 disposed within cylindrical tube 286. Scrubber 390 is preferably a cylindrical pressed carbon monolith having a plurality of longitudinal passageways 392 providing thereby a large surface area for adsorption of hydrocarbon emissions. Carbon monolith scrubber 390 may be formed from a special adsorbent material such as, for example, a rolled felted carbon material, such as Kynol™, available from American Kynol, Inc. of Pleasantville, N.Y. Vapor flowing into insert end 287 as in embodiment 210 must then pass through scrubber 390 before exiting at atmosphere port 338.

As noted above and shown in FIGS. 2 and 3, inclusion of such a scrubber at the end of the vapor flowpath is known in the art. Third embodiment 310 is intended to meet PZEV standards when the carbon volume of chambers 314,316 is sized properly for a specific emissions load, similar to the requirement for LEV II in embodiment 210.

An important manufacturing advantage of canister embodiment 210 is that it provides a common platform for either LEV II or PZEV applications simply by adding or omitting scrubber 390. No other changes are required and the footprint within a vehicle is identical.

Scrubber 390 is inserted into cylindrical tube 286 during assembly of embodiment 310 and must be retained in place during the working lifetime of the canister. First and second retaining seals 394 may be installed at the periphery of each end of scrubber 390, seals 394 having flexible wipers 396 similar to insert wipers 180 for centering the scrubber within the canister. Alternatively, the scrubber may be retained by annular polymeric gaskets (not shown), which may be formed in known fashion from a cross-linkable elastomeric composition such as a silicone and may be installed with the scrubber in liquid form prior to becoming cross-linked.

Figure 10:
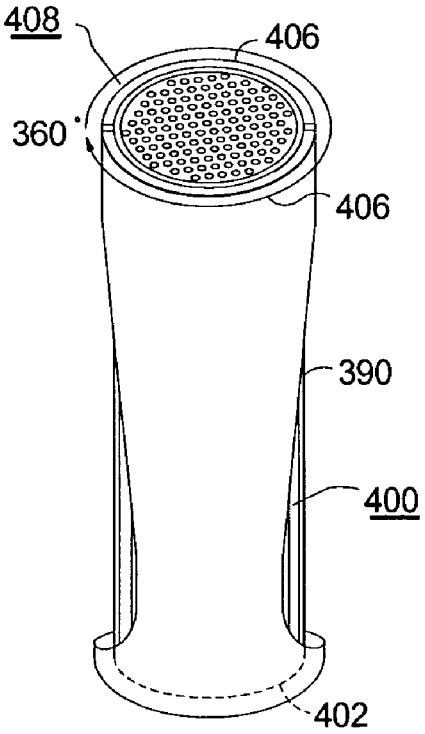
FIG. 10 is an isometric view from above showing the sling shown in FIG. 9 installed onto the scrubber shown in FIG. 8 to form a sub-assembly in preparation for insertion into the tube shown in FIGS. 7, 11, and 12.
Figure 9:
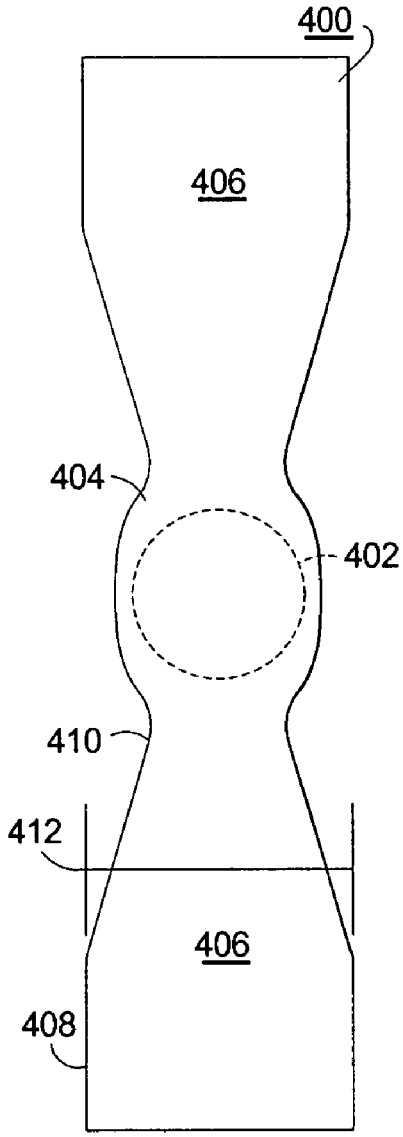
FIG. 9 is a plan view of a resilient sling for holding and centering the scrubber shown in FIG. 8.
Figure 12:
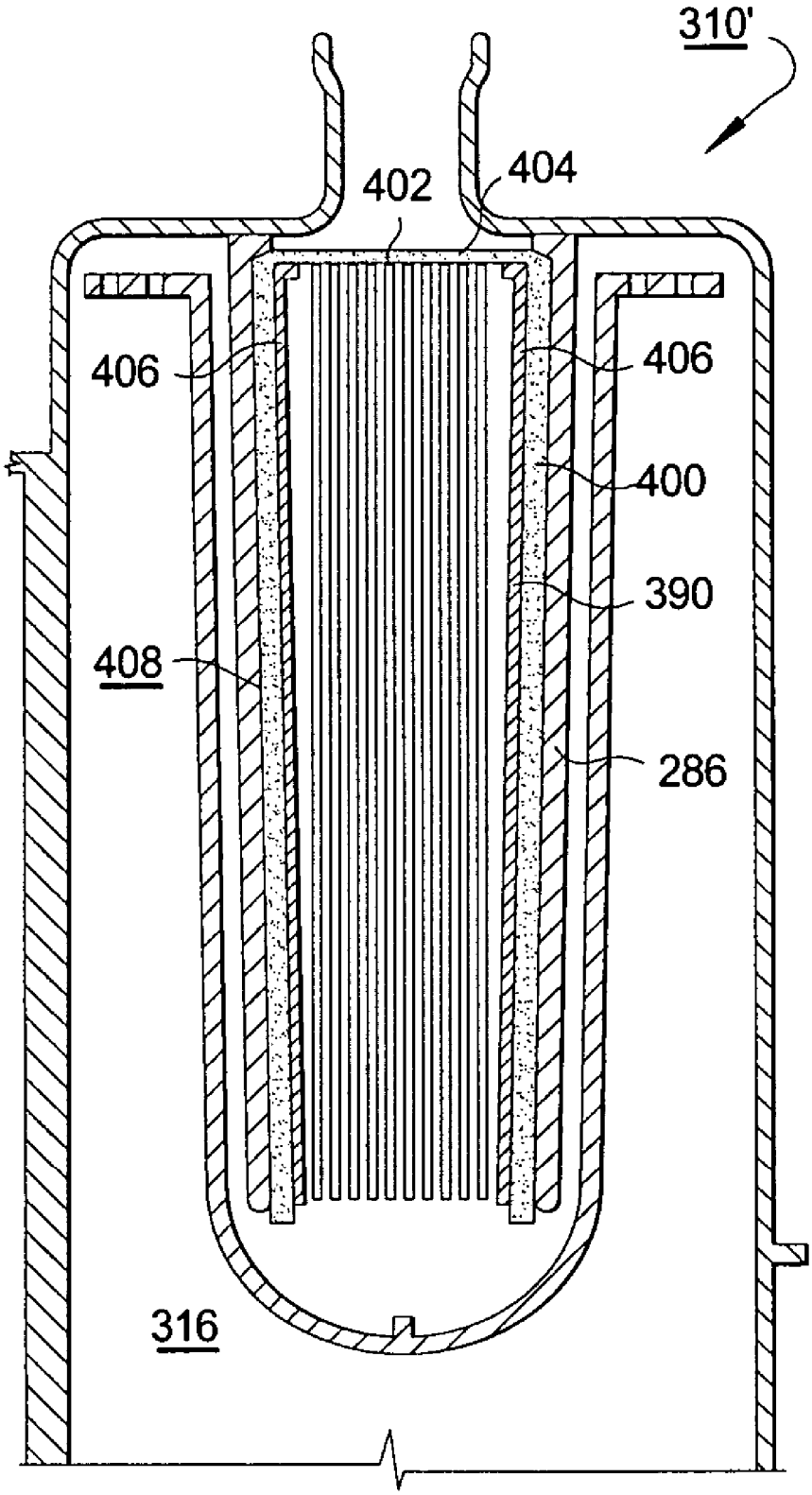
FIG. 12 is an elevational cross-sectional view showing the sling and scrubber shown in FIG. 10 installed as an alternative form of the third embodiment shown in FIG. 11.

Because a scrubber formed as a carbon monolith is relatively fragile and easily damaged, such a scrubber is vulnerable to shock and vibration. In addition, silicone elastomers such as Viton are known to exhibit relatively high coefficients of thermal expansion. Under cold start conditions, for example, in the arctic, a scrubber could become loose in its mountings and be damaged. Referring to FIGS. 9, 10, and 12, in a currently preferred configuration 310' of embodiment 310, a flexible, porous, resilient sling 400 is provided for installing and retaining scrubber 390 within cylindrical tube 286 in lieu of either seals 394 (FIG. 11) or elastomeric gaskets. In installation, an end 402 of scrubber

390 is placed on a center portion 404 of sling 400, and straps 406 are folded alongside the cylindrical surface of scrubber 390 to form a sub-assembly 408, as shown in FIG. 10. In a preferred embodiment, straps 406 are flared out so that ends 408 are larger in cross-section than neck sections 410. The widths 412 of ends 408 are selected to assure that ends 408 envelop the body scrubber 390 for a full 360°. Prior to insertion of insert 170 into the canister as described above, sub-assembly 408 is inserted into tube 286, followed by insertion of insert 170, as shown in FIG. 12. Preferably, sling 400 is die-cut from planar stock of either a loose, thick, woven polyester fabric or an open-cell resilient foam.

Advantages of sling 400 over an annular resilient elastomeric gasket are a) cost, b) much greater ease of assembly of embodiment 310' over embodiment 310, and c) the outer surface of scrubber 390 is made available as additional vapor adsorption area.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In a canister for selectively adsorbing and desorbing fuel vapor emissions, a resilient sling having strap portions and a central portion for retaining a fuel vapor adsorbing medium in said canister.

2. A resilient sling in accordance with claim 1 wherein said sling is formed from a porous medium.

3. A resilient sling in accordance with claim 2 wherein said resilient porous medium is selected from the group consisting of woven polyester fabric and open-cell plastic foam.

4. A resilient sling in accordance with claim 2 wherein said sling is formed by cutting from planar stock of said porous medium.

5. A resilient sling in accordance with claim 1 wherein said fuel vapor adsorbing medium is a porous carbon monolith.

6. A canister for selectively adsorbing and desorbing fuel vapor emissions from a fuel vapor source to prevent such fuel vapors from escaping to atmosphere, comprising:

a) a housing;

b) a fuel vapor adsorbing medium disposed in said housing; and c) a resilient sling for retaining said fuel vapor adsorbing medium in said housing.

7. A canister in accordance with claim 6 wherein said sling comprises a central portion for receiving an end of said fuel vapor adsorbing medium and first and second strap portions for extending along opposed sides of said fuel vapor adsorbing medium between said fuel vapor adsorbing medium and said housing.

* * * * *